United States Patent [19]

Tamary

[11] 4,429,990

[45] Feb. 7, 1984

[54] APPARATUS FOR CONTROLLING THE APPLICATION OF FUSER RELEASE MATERIAL IN ROLLER FUSERS

[75] Inventor: Ernest J. Tamary, Rochester, N.Y.

[73] Assignee: Eastman Kodak Company, Rochester, N.Y.

[21] Appl. No.: 362,436

[22] Filed: Mar. 26, 1982

[51] Int. Cl.[3] ..... G03G 15/00

[52] U.S. Cl. ..... 355/14 FU; 355/3 FU; 355/14 R; 219/469; 432/60; 118/60

[58] Field of Search ..... 432/60, 59, 61, 62, 432/227, 228; 355/3 FU, 14 FU, 14 R; 219/216, 469; 118/60, 101, 260, DIG. 1

[56] References Cited

U.S. PATENT DOCUMENTS

| | | | |
|---|---|---|---|
| 3,880,577 | 4/1975 | Tomono et al. | 432/60 |
| 3,924,564 | 12/1975 | Bar-on | 118/60 |
| 3,941,085 | 3/1976 | Hattler et al. | 118/60 |
| 4,079,229 | 3/1978 | Takiguchi | 219/216 |
| 4,085,702 | 4/1978 | Consaul et al. | 118/60 |
| 4,149,797 | 4/1979 | Imperial | 355/3 FU |
| 4,185,140 | 1/1980 | Strella et al. | 355/3 FU |
| 4,193,681 | 3/1980 | Tanigawa et al. | 355/3 FU |
| 4,272,666 | 6/1981 | Collin | 219/216 |
| 4,277,161 | 7/1981 | Calabrese | 355/3 FU |
| 4,285,295 | 8/1981 | Iwao et al. | 118/60 |

*Primary Examiner*—A. C. Prescott

*Attorney, Agent, or Firm*—William F. Noval

[57] ABSTRACT

Apparatus for controlling the application of fuser release material such as fuser oil to a roller fuser in an electrographic copier. The number of fixable images or the number of photoconductor frames are counted after the start of a copy run and compared with the number of copies which exit from the copier to determine if the two counts bear a preselected numerical relationship to each other. If they do, fuser oil is applied to the roller fuser; if they do not, application of fuser oil is discontinued until the two counts bear such numerical relationship.

8 Claims, 4 Drawing Figures

APPARATUS FOR CONTROLLING THE APPLICATION OF FUSER RELEASE MATERIAL IN ROLLER FUSERS

BACKGROUND OF THE INVENTION

This invention relates to the fusing of toner images in electrographic apparatus. More particularly, this invention relates to a roller fuser which selectively fuses copy sheets carrying simplex or duplex toner images and to the control of the application of fuser release material to such roller fuser in order to maintain the amount of fuser release material applied to the fuser at a optimal rate per copy sheet.

In the electrophotographic process, toner images corresponding to the images of original documents are sequentially formed on a photoconductor and transferred to copy sheets to which the images are permanently fixed such as by the application of heat and/or pressure. In the production of a simplex copy, a toner image is formed on only one side of a copy sheet, whereas in the production of a duplex copy, toner images are formed on both sides of a copy sheet. In either case, one technique for permanently fusing the toner image(s) to the copy sheet is by passing the sheet through the nip of a pair of fuser rollers either one or both of which are heated and which are in pressure engagement. Since there is a tendency for toner to offset onto a heated roller, it has been customary to form the fusing layer of one or both of the fuser rollers with a material which is highly resistant to offsetting or sticking of toner. Typical of such materials are those which are resistant to degradation at high fusing temperatures such as polytetrafluoroethylene resin, silicone elastomer, flurosilicone elastomer, and the elastomer comprising a copolymer of tetra-fluoroethylene and polypropylene.

In order to increase the efficiency of fusing layers which are highly resistant to toner offset, it has been customary to apply fuser release material such as fuser oil to the fusing layer surface as it comes into contact with copy sheets having toner images to be fused. Ideally, the amount of fuser oil applied to the fuser rollers should be maintained at an optimum level over the entire surface of the rollers and for the duration of a copy run. However, in practice, this has not always been easy to accomplish. Thus, if elastomers are used as the fusing layer, the application of fuser oil of a similar composition as the elastomer (e.g., the application of silicone oil to a silicone elastomer), causes the elastomeric material to swell and to degrade over a period of time. If too little fuser oil is applied to the fuser roller surface, the surface tends to become contaminated with toner and other debris. On the other hand, if too much fuser oil is applied to the surface of the fuser roller, too much oil will be deposited on the fused copy sheets, causing undesirable staining of the sheets. Since a certain amount of fuser oil will be removed by each copy sheet processed by the roller fuser, a difficulty arises when simplex and duplex copies are randomly processed by the roller fuser. Since in the simplex copy mode twice as many copy sheets will be processed by the roller fuser than in the duplex copy mode, if the rate of fuser oil application to the fuser rollers is not adjusted for this change in copy mode, then undesirable under- or over-application of fuser oil to the roller fuser will result.

Heretofore, many techniques for controlling the rate of application of fuser oil to a roller fuser have utilized either a predetermined quantity of oil to be applied per unit of time or a predetermined quantity of oil to be applied per image area or frame count of a photoconductor. Such techniques have a number of disadvantages. Where fuser oil is added as a function of the count of number of image frames of a photocoductor which pass a sensor, difficulties arise if the frame count does not equal the copy count because of extra frames which are counted at the beginning and the end of a copy run. If the copier is run in a single pass duplex mode such as disclosed in U.S. Pat. No. 4,095,979, there will be twice as many image frames counted as the number of copies exiting from the copier thus causing an excess of fuser oil to be applied. Moreover, in certain types of copiers using a recirculating feeder, the time for recirculating only two documents to be copied in a collate mode may be greater than the time for the passage of two frames of the photoconductor, thus causing inaccuracies in fuser oil applications. Where fuser oil is applied as a function of time, difficulties may arise due to synchronization inaccuracies between real time clocks and copy count caused by jams in the copiers at the end of runs, by variations in copy throughput because of the selection of simplex or duplex mode and by voltage variations in the copier electrical system.

SUMMARY OF THE INVENTION

According to the present invention, there is provided apparatus for controlling the amount of fuser release material such as fuser oil applied to a roller fuser in an electrographic copier which accounts for variations in the difference between photoconductor frame count and copy count caused by conditions at the beginning and end of copy runs and by the choice of simplex or duplex operation of the copier. According to the invention, the amount of fuser oil applied to the rollers of a roller fuser is maintained at an optimum level over short or long copy runs so that inadequate fuser oil on the rollers is prevented, thus eliminating buildup of toner and other debris on the rollers and consequent adherence of copy sheets to the rollers. Buildup of too much fuser oil on the rollers is avoided, eliminating staining of copy sheets as they exit from the roller fuser. According to an aspect of the invention, apparatus is provided for controlling the rate of fuser release material applied to a roller fuser by separately counting (1) either the number of fixable images or the number of photoconductor frames after the start of a copy run and (2) the number of copies which exit from the copier to determine if the two counts bear a preselected relationship to each other. If the counts bear such a relationship, then fuser oil is applied to the fuser rollers. However, if the counts do not bear such a numerical relationship, then application of fuser oil is discontinued until such time as the two counts bear such numerical relationship. Preferably the preselected numerical relationship comprises an equality between the two counts.

The invention, and its features and advantages, will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which.

DESCRIPTION OF THE PREFERRED EMBODIMENT

Figure 1:
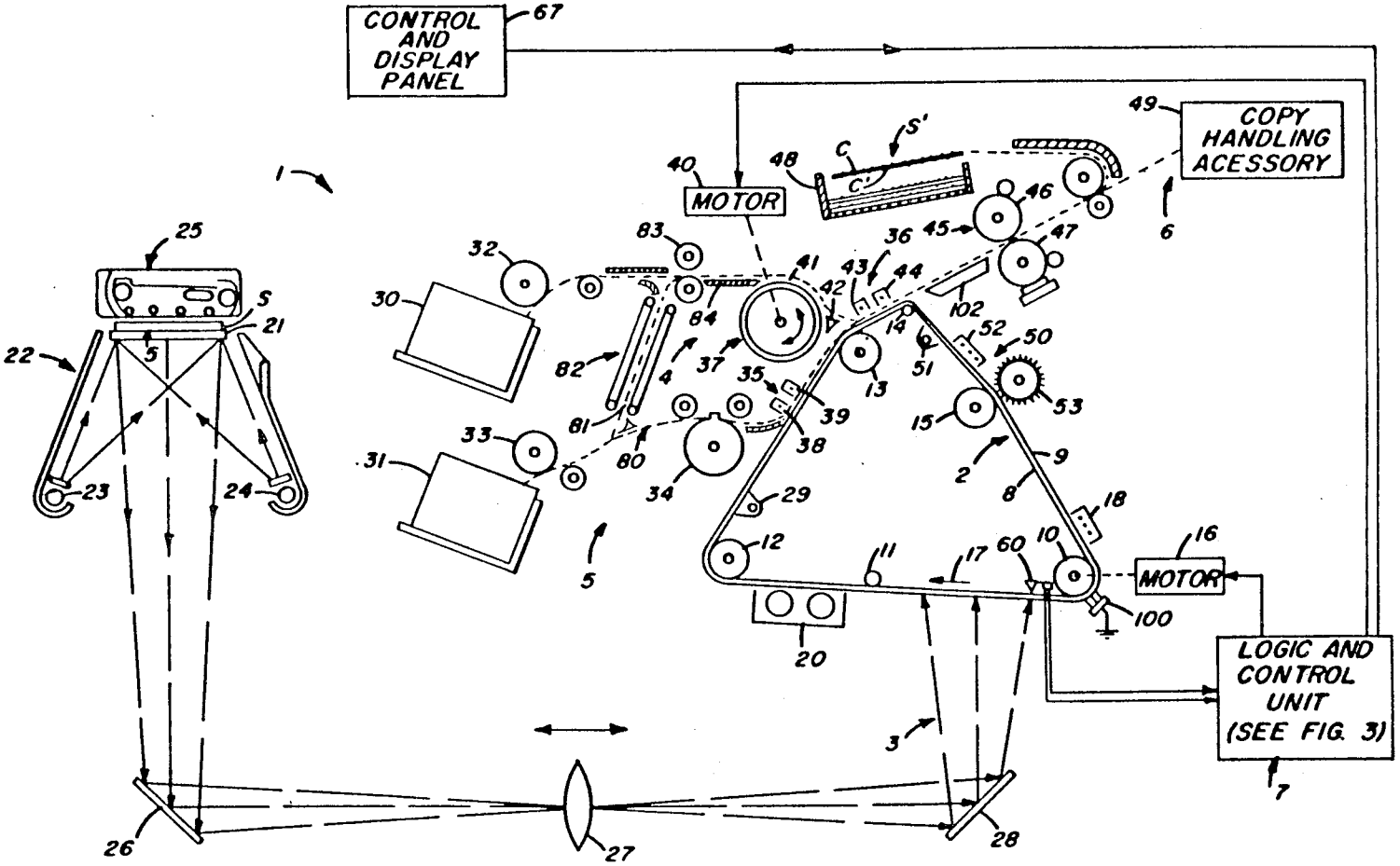
FIG. 1 is a diagrammatic view of electrophotograhic apparatus including a fuser oil control apparatus according to the present invention.

Referring now to FIG. 1, there is schematically illustrated electrophotographic apparatus 1 including control apparatus for applying fuser release material such as oil to a roller fuser according to the present invention. Only those features of a copier which are helpful for a full understanding of the preferred embodiment are described hereafter. The electrophotographic apparatus shown is capable of producing either simplex or duplex copies and for a more complete description of such a simplex/duplex copier, reference is made to commonly assigned U.S. Pat. Nos. 4,095,979 and 4,174,905, the disclosures of which are incorporated herein by reference. The apparatus for controlling the application of fuser oil to a roller fuser may also be used in a simplex-type copier, such as that shown and described in commonly assigned U.S. Pat. No. 3,914,047.

As shown in FIG. 1, electrophotographic apparatus 1 includes, among other elements, image transfer member 2, image forming section 3, copy sheet duplexing/simplexing section 4, copy sheet input and output sections 5 and 6, respectively, and logic and control unit 7. Image forming section 3 forms transferable toner images on image transfer member 2. Copy sheet input section 5 supplies copy sheets. Copy sheet duplexing-/simplexing section 4 transfers simplex or duplex toner images from transfer member 2 to either or both sides of a copy sheet supplied by input section 5. Copy sheet output section 6 fixes the simplex or duplex images to the copy sheet to provide a final copy and delivers the copy to an output hopper or to a copy handling accessory. Logic and control unit 7 coordinates the operation of the various elements of apparatus 1 to produce final copies.

Image transfer member 2 may be any member upon which transferable images may be formed and from which the images may be transferred to a copy sheet. In the preferred form of apparatus shown in FIG. 1, member 2 includes a transparent support 8 and a photoconductor 9 backed by a conductive layer (not shown) grounded by grounding brushes 100. Member 2 is in the form of an endless belt trained about rollers 10, 11, 12, 13, 14, and 15. Member 2 is segmented into a plurality of image areas or frames which extend across the width of member 2 and on which toner images are formed. Thus, member 2 is made up of a series of areas which may contain sequentially formed images. As disclosed in more detail in U.S. Pat. No. 3,914,047, along the border of member 2 are disposed two rows of indicia or perforations, in one row of which there is a perforation for each frame on member 2 and in the other row of which is a plurality of equally-spaced perforations between the frame perforations of the first row. These two rows of perforations are sensed by suitable sensors such as the bimorph sensors described in said patent. The frame perforations of the first row provide an indication of the start of an image frame to logic and control unit 7 and the plurality of perforations between image frames of the second row provide timing signals to unit 7 to actuate the various work stations disposed about member 2 and the actuable mechanisms in the copy sheet path.

Roller 10 is coupled to a drive motor 16 actuated by unit 7 to move member 2 in a clockwise direction indicated by arrow 17 past various electrophotographic work stations as described below.

Image forming means 3 includes a charging station 18 at which the photoconductor 9 of member 2 receives a uniform electrostatic charge from a suitable device such as a corona charger; an exposure station 19 at which the image of an original to be copied is projected onto charged photoconductor 9 to thereby dissipate electrostatic charge at exposed areas of member 2 to form a latent electrostatic image corresponding to the original image; and a developing station 20 at which developing powder including toner particles having electrostatic charge opposite to that of the latent electrostatic image is brushed over member 2 to develop the latent electrostatic image into a transferable toner image corresponding to the original image.

Charging station 18 is shown as including a corona charger which may, for example, be a three-wire, grid-control type which establishes a uniform negative surface potential on member 2. Exposure station 19 includes transparent platen 21 upon which originals to be copied are positioned, an illumination source 22 including flash lamps 23 and 24 and projection optics such as mirrors 26 and 28 and lens 27 which may be movably mounted to permit reduced or enlarged image reproduction. Although documents to be copied may be manually positioned on platen 21 for improved copier efficiency, it is preferable to automatically position documents on platen 21. Thus, recirculating feeder 25 is shown positioned over platen 21 and acts to automatically and sequentially position documents S on platen 21. Recirculating feeder 25 may take the form of a feeder which presents either the single sides of copy sheets to the platen or may sequentially present both sides of a copy sheet to the platen. Such a recirculating feeder is shown and described in commonly assigned U.S. Pat. No. 4,158,500 and 4,192,607. Alternatively, recirculating feeder 25 may only be capable of presenting the first sides of sequentially presented documents to platen 21. Such a simplex feeder is shown and described in commonly assigned U.S. Pat. Nos. 4,099,860; 4,134,672; and U.S. Pat. No. Re. 27,976. Documents may also be automatically positioned on platen 21 by means of a document handler such as that disclosed in the aforementioned U.S. Pat. No. 4,192,607.

In any case, feeder 25 places a selected side C of a sheet of document S with side C facing platen 21. When energized, flash lamps 23 and 24 illuminate side C of document S to produce a light image which is projected onto member 2 by mirrors 26 and 28 and lens 27 to produce a corresponding latent electrostatic image.

Development station 20, which may include a magnetic brush developer, causes developer including toner particles having an electrostatic charge opposite to that of the electrostatic latent image to be brushed over member 2. The toner particles adhere to the latent electrostatic image to form a transferable, visible toner image.

Post development erase station 29 includes an infrared illumination source which reduces the electrical stress on the photoconductor 9 and reduces the level of the electrostatic charge.

Copy sheet input section 5 includes supplies 30 and 31 of copy sheets S' of any suitable material such as paper, transparencies or the like. When apparatus 1 is operating in the simplex mode, sequential simplex images are formed on photoconductor 9 of member 2 and copy sheets are supplied from supply 31 by a vacuum roller 33 along sheet path 81 by transport belts 82 to rollers 83 or from supply 30 by vacuum roller 32 to rollers 83. Feed rollers 83 then move sheet S' over guide 84 to vacuum roller 41 which is rotated in a clockwise direction to register the copy sheet S' with a simplex image on photoconductor 9. Second transfer charger 43 transfers the toner image on photoconductor 9 to one side of copy sheet S'. The electrostatic charge between photoconductor 9 and the copy sheet is then neutralized by second detack charger 44 of second transfer station 36 and the copy sheet separated from belt member 2 at roller 14.

When copier 1 is operated in the duplex mode, a copy sheet S' is separated from supply 31 by vacuum roller 33 and transported over path 80 to registration mechanism 34 which registers the copy sheet with the first of two sequential toner images formed on belt 9. The first toner image is then transferred to the first side of copy sheet S' by means of first transfer charger 38 of first station 35. Thereafter, first detack charger 39 neutralizes the electrostatic attraction between copy sheet S' and member 2 and vacuum drum 41 (which is rotated in a counterclockwise direction) separates the copy sheet from contact with member 2. After the copy sheet has been completely separated from belt member 2, the direction of rotation of vacuum drum 37 is reversed to bring the second side of copy sheet S' into registration with the second toner image on photo- conductor 9 in advance of second transfer station 36. Second transfer charger 43 then transfers the second image to the second side of copy sheet S', second detack charger 44 neutralizes the electro- static attraction between copy sheet S' and member 2 and the copy sheet separates from member 2 at roller 14.

Copy sheet S' carrying either one or two unfixed images is transported to a roller fuser 45 by means of a fluid transport device 102 such as that disclosed in commonly assigned U.S. patent application Ser. No. 362,435 filed Mar. 26, 1982, in the name of A. I. Ateya and entitled Apparatus for Supporting Flexible Members. The unfixed toner images are permanently fused to copy sheet S' by means of heated rollers 46 and 47 which are in pressure engagement. Copy sheet S' is then transported either to output tray 48 or to a copy handling accessory 49 such as the finisher shown and described in commonly assigned U.S. Pat. No. 4,134,672.

Figure 2:
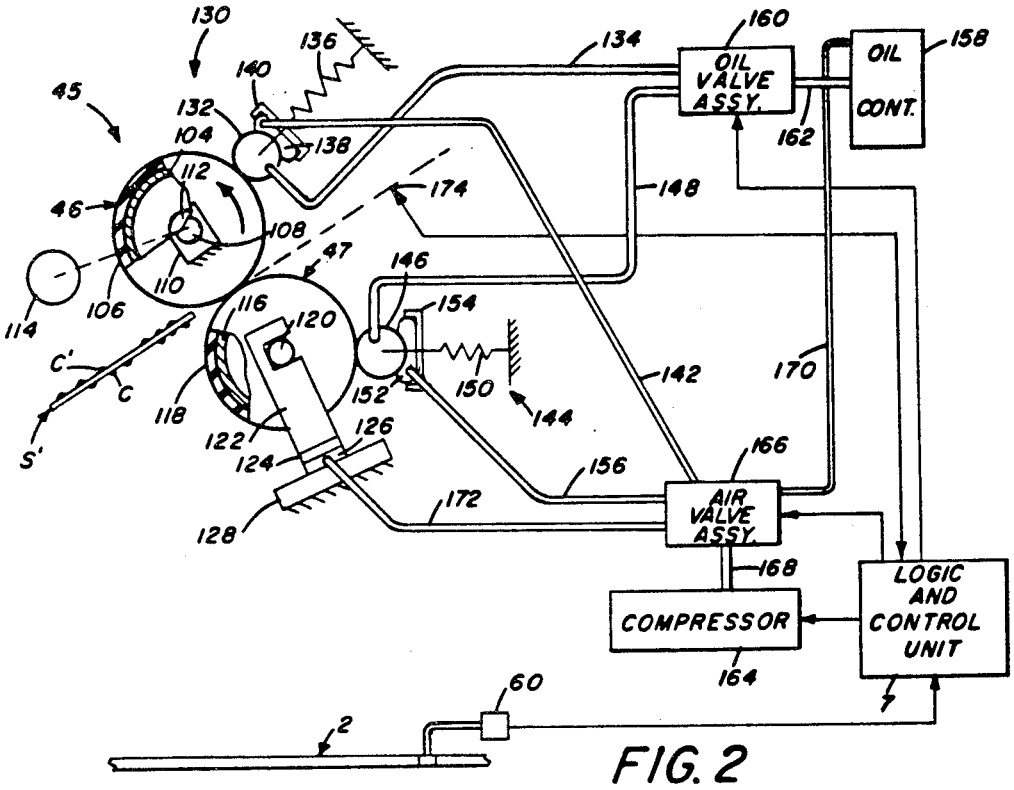
FIG. 2 is a partially schematic, partially elevational view of the fuser oil control apparatus shown in FIG. 1.

Referring now to FIG. 2 there is shown, in greater detail, roller fuser 45 which incorporates the fuser oil control apparatus of the present invention. As shown, roller 46 includes an inner cylindrical core 104 of heat conductive material such as aluminum and a fuser layer 106 of high temperature resistant elastomeric material such as silicone elastomer which is highly resistant to the sticking or offsetting of toner and other debris from copy sheets being fused. Roller 46 is fixedly mounted by means of gudgeons 108 in bearing members 110 mounted on the frame of copier apparatus 1. The fuser layer 106 of roller 46 is heated by means of a quartz lamp 112 mounted within core 104. Roller 46 is rotated in a counterclockwise direction by means of drive 114.

Similarly, roller 47 includes a heat conductive cylindrical metal core 116 and an outer fuser layer 118 of silicon elastomer. Also mounted internally of core 116 is a quartz lamp (not shown) which heats fuser layer 118. Roller 47 is mounted by means of gudgeons 120 in a frame 122 which is movable toward and away from fixed roller 46 so that roller 47 may be moved into and out of pressure engagement with roller 46. This movement is effected by means of an expandable bladder 124 secured to the lower member 126 of frame 122 and to a frame member 128 of copier 1.

In order to further reduce the tendency of toner to offset, there is applied to the surfaces of rollers 46 and 47, an appropriate fuser release material such as fuser oil, (e.g., silicone oil, fluorosilicone oil or the like). Fuser oil applicator 130 includes a hollow porous application roller 132 which is supplied fuser oil internally through conduit 134. Roller 132 is normally biased out of engagement with fuser roller 46 by bias spring 136 but is moved into engagement with roller 46 by the expansion of bladder 138 which is disposed between roller 132 and applicator frame 140. Bladder 138 is supplied with pressurized gaseous medium such as air through conduit 142. In like manner, fuser oil applicator 144 includes hollow porous applicator roller 146 supplied fuser oil internally by means of conduit 148. Roller 146 is biased out of engagement with fuser roller 47 by means of spring 150. Roller 146 is moved into engagement with roller 47 by means of the expansion of bladder 152 which is positioned between roller 146 and applicator frame 154. Pressurized air is supplied to bladder 152 by conduit 156.

As shown in FIG. 2, fuser oil is stored in a container 158 which is connected to oil valve assembly 160 by conduit 162. Oil valve assembly 160 selectively applies oil to applicator rollers 132 and 146 over conduits 134 and 148, respectively. Pressurized air is produced by compressor 164 which supplies air to air valve assembly 166 through conduit 168. Air valve assembly 166 selectively applies pressurized air to oil container 158 over conduit 170, to bladder 126 over conduit 172 and to bladders 138 and 152 over conduits 142 and 156, respectively.

Compressor 164, air valve assembly 166, and oil valve assembly 160 are actuated by command signals from logic and control unit 7 which also receives a copy sheet finished count signal from detector 174 located in the path of copy sheets at the exit of roller fuser 45 and a frame count signal from frame detector 60.

Figure 3:
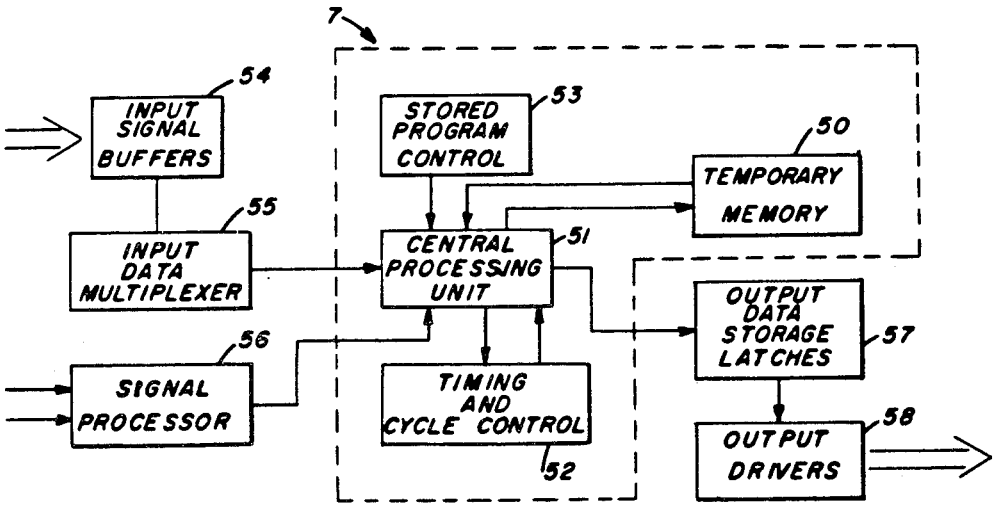
FIG. 3 is a block diagram of the logic and control unit of FIG. 1.

As shown in FIGS. 1 and 2, and more particularly in FIG. 3, operation of copier 1 and its related accessories such as feeder 25 and copy handling accessory 49 is monitored and controlled by a digital microprocessor incorporated in logic and control unit 7. Programming of a number of commercially available minicomputers or microprocessors, such as INTEL Model 8080 A Microprocessor (which along with others can be used in accordance with the present invention), is a conventional skill well understood in the art and, for example, is described in Chapter 4 of "An Introduction to Microcomputers"; Vol. 2; published by Adam Osborne and Associates, Inc.; Berkeley, Calif., 1977. The following disclosure is written to enable a programmer having ordinary skill in the art to produce an appropriate program for the computer. The specific details of any such program would of course depend on the architecture of the selected computer.

Referring now to FIG. 3, there is shown a block diagram of a typical logic and control unit 7 which interfaces with copier 1 and feeder 25. Unit 7 consists of temporary data storage memory 50, central processing unit 51, timing and cycle control unit 52 and stored program control 53. Data input and output is performed sequentially under program control. Input data is applied either through input signal buffers 54 to a multiplexer 55 or to signal processor 56 from perforations detected on belt member 2 by detector 60. The input signals are derived from various switches, sensors and analog to digital converters. The output data and control signals are applied to storage latches 57 which provide inputs to suitable output drivers 58 which are connected to the work stations by suitable electrical connections. More specifically, the output signals from logic and control unit 7 are logic level digital signals which are buffered and amplified to provide drive signals to various clutches, brakes, solenoids, power switches, and the like in various copier work stations such as roller fuser 45 and in feeder 25 and copier handling accessory 49. The processing functions of unit 7 can be programmed by changing the instructions stored in the computer memory 53.

A control and display panel 67 is provided on copier apparatus 1 and includes operator selectable switches and controls for such functions as number of copies desired, choice of simplex or duplex copying, etc., and also includes displays to include information such as number of copies selected, number of copies produced, jam conditions in the copier or its accessories, etc.

The time sequence of machine events and their relationship to each other is controlled as noted above by sensing perforations which correspond to the location of the image areas or frames on member 2 as these frames continue to cycle through the copier's endless path. Thus, the detection of perforations by detector 60 is applied to logic and control unit 7 through signal processor 56 (see FIG. 3) and is used to synchronize the various control mechanisms with the location of the image elements. Thus, the feeding of documents sequentially onto platen 21 by recirculating feeder 25, the successive flashing of flash lamps 23 and 24 to produce latent electrostatic images corresponding to the document images on belt member 2, the feeding of copy sheets by vacuum rollers 32 or 33 from stacks 30 and 31, respectively, the release of registration mechanism 34 to register a copy sheet with a toned image on belt 2, the proper rotation of drum 37 by motor 40 depending upon whether the simplex or duplex mode is selected, the control of roller fuser 45 and the deposit of a finished copy into tray 68 or transport of a copy to copy handling accessory 49 are suitably controlled in proper sequence through logic and control unit 7.

The program to effect the proper operation of copier 1 is located in stored program control 53 which may comprise a conventional Read Only Memory (ROM). The ROM contains the operation program in the form of instructions in fixed binary numbers corresponding to numeric constants. These programs are permanently stored in the ROM's and cannot be altered by the computer operation. The ROM may be programmed at the manufacturer's facility and the program provide the required control functions such as sequential control, jam recovery, operator observable logic machine timing, copy sheet duplexing, and the like. For a specific example, the total ROM capacity may be approximately 32,000 bytes with each byte being eight bits in length. More than one ROM may be required. The temporary storage memory 50 may be a conventional Random Access Memory (RAM). Data such as copy request count, copies processed count, and copies delivered count, as indicated by detector 174 are stored in the RAM until successful completion of a copy cycle. The RAM is also used to store data being operated on by the computer and to store the results of computer calculations. A more complete description of the logic and control unit which may be used in the present invention for controlling a copier is shown and described in the aforementioned U.S. Pat. No. 3,914,047 which is incorporated herein by reference.

Referring once again to FIG. 2, the operation of roller fuser 2 as controlled by logic and control unit 7 will now be described. When the copy run has been initiated through operator selection of appropriate switches on display panel 67 so that logic and control unit 7 will initiate appropriate signals to effect the start of the electrophotographic cycle, a signal will be sent by logic and control unit 7 over lead 176 to start compressor 164 so that a source of pressurized air is provided. Thereafter, unit 7 will send a signal to air valve assembly 166 to open the inlet to conduit 170 so that pressurized air may be applied to the surface of fuser oil in container 158 so that it may be fed to applicator rollers 132 and 146 under pressure. Logic and control unit 7 also sends a signal to air valve assembly 166 to apply pressurized air over conduit 172 to fuser roller bladder 126 to expand it thereby bringing roller 47 into engagement with roller 46. Previous to this, unit 7 will have sent a signal to drive 114 to start rotation of roller 46 so that when roller 47 is brought into engagement with roller 46, roller 47 will also be rotated by roller 46. Thereafter, a signal from logic and control unit 7 to air valve assembly 166 causes pressurized air to be fed over conduits 142 and 156 to expand bladders 138 and 152, respectively. Applicator rollers 132 and 146 will be brought into contact with fuser rollers 46 and 47 to apply fuser oil thereto.

Figure 4:
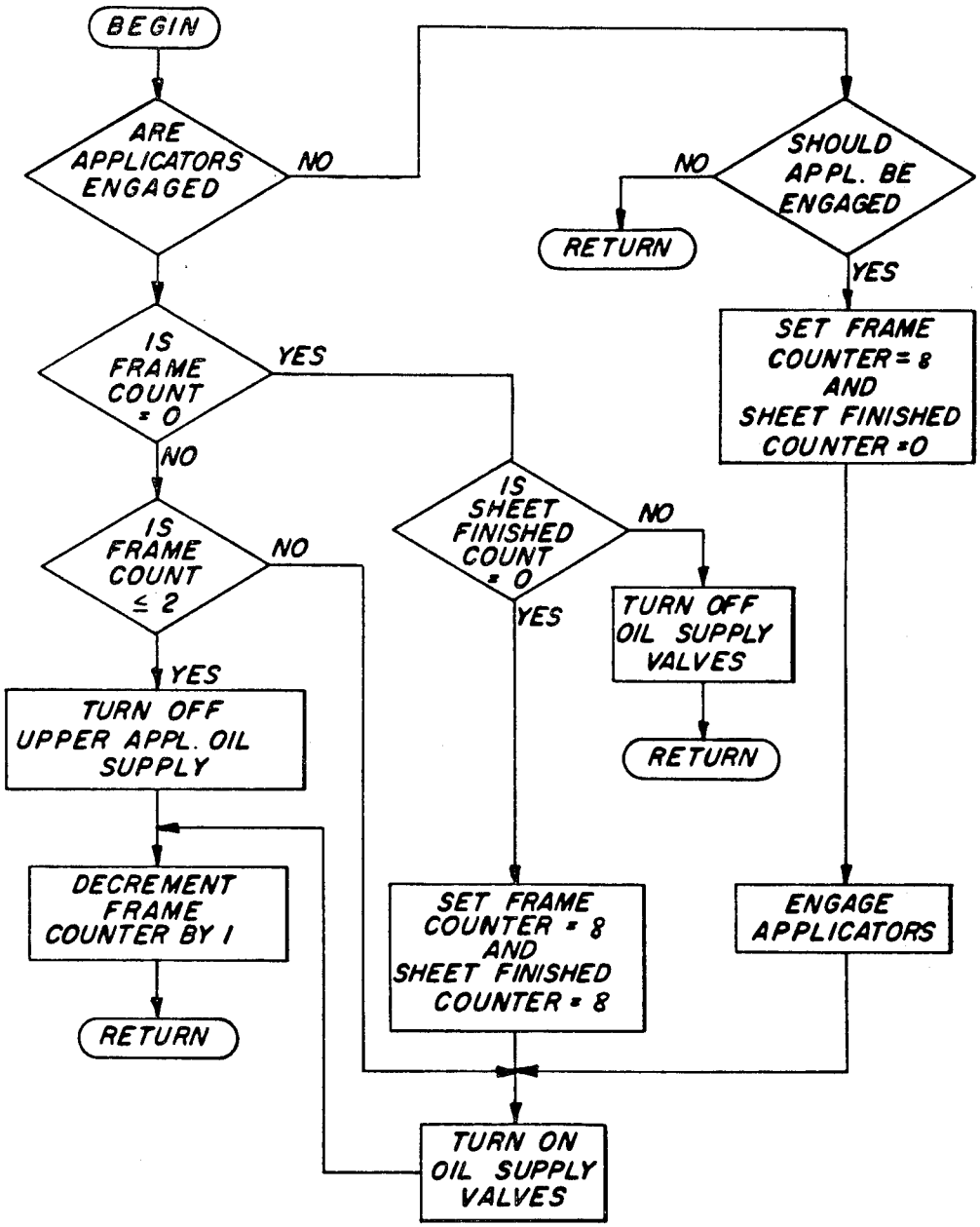
FIG. 4 is a flow chart of the logic sequence of operation of the fuser oil control apparatus of FIG. 1 according to the present invention.

Referring now to FIG. 4, there is shown a flowchart of a routine for logic and control unit 7 to control the amount of fuser oil applied by rollers 132 and 146 to fuser rollers 46 and 47. At the start of the routine, the applicator roller engagement bladders 134 and 152 are sensed to determine whether or not rollers 132 and 146 have been engaged with fuser rollers 46 and 47. If they have not been, the control unit 7 samples the program control to determine if they should be. If the decision is no, then the routine is returned to the beginning. If the decision is yes, then logic and control unit 7 sends the appropriate signals to engage rollers 132 and 146 with rollers 46 and 47, respectively.

Logic and control unit 7 is programmed to monitor two sets of counts for controlling the application of fuser oil to roller fuser 45. One count is the number of image frames up to a predetermined number after the start of a copy run. Several frames at the very start of the copy run are discarded in the count since it takes a certain number of frames before the first imaged frame is transferred to a copy sheet and fed into roller fuser 45. The other count monitored by logic and control unit 7 according to the present invention is the number of finished copy sheets exiting from roller fuser 45. Both the frame count and the finished sheet count are set in logic and control unit 7, for example, to equal the same number "8". Thus, in the flowchart of FIG. 4, once the applicators have been engaged, then the frame count and finished sheet count are set at "8", and the valves to oil conduits 134 and 148 are turned on so that applicator rollers 132 and 146 apply fuser oil to the surfaces of rollers 46 and 47.

If the sampling resulted in a decision that applicators 130 and 144 had been engaged, then the frame count is sampled to determine whether or not it is equal to zero. Logic and control unit 7 receives counts of frames from the F perf detector 60. If the answer is yes, then the copy sheet counter is sampled to detemine whether or not it is equal to zero. Logic and control unit 7 receives copy sheet count signals from detector 174 located in the copy sheet path downstream from roller fuser 45.

If the copy sheet count is not equal to zero, then the valves of oil valve assembly 160 to oil conduits 134 and 148 are turned off by a signal from logic and control unit 7 so that applicator rollers 132 and 146 no longer supply oil to fuser rollers 46 and 47. If the perf frame count equals zero, and the copy sheet finish count equals zero, then the frame counter and the sheet finished counter are reset to preselected numbers such as 8, and the valves to conduits 134 and 148 are turned on by logic and control unit 7 so that fuser oil may be applied to rollers 45 and 47.

If in sampling the frame count, it was found that it was not equal to zero, then the frame count is further sampled to determine whether or not it is less than or equal to two. If it is not, then logic and control unit 7 sends a signal to valve assembly 160 to supply fuser oil over conduits 134 and 148.

If the frame count is determined to be equal to or less than two, then the valve supplying oil to conduit 134 is turned off and the frame count is decremented by one. The routine is now returned to the beginning to start it again.

According to the present invention as described with respect to the apparatus shown and described in FIGS. 1–4, the initiation of the application of fuser oil to rollers 46 and 47 by applicators 130 and 144 is delayed for a certain number of frames after the start of a copy run. This enables the frame which has been flashed first to be moved around to a position in registration with a copy sheet so that fuser oil is applied to rollers 46 and 47 just prior to the entry of a copy sheet having toner images thereon into the nip of rollers 46 and 47. This prevents buildup of fuser oil on rollers 46 and 47 so that the first sheets passed through the nip formed by rollers 46 and 47 will not be subjected to excessive oil which may cause staining of the copy sheets. The number of copy sheets exiting from roller fuser 45 is continuously monitored and compared to the number of image frames which have been imaged during a copy run. If the number of image frames reaches a predetermined number such as 8 before the number of copy sheets exiting from fuser roller 45 reaches that number (thus indicating that the copier is operating in a mode other than one in which a copy sheet is supplied and fused for each image frame that is flashed), then the fuser oil supplied to applicators 130 and 144 is shut off. Excessive buildup of oil on rollers 46 and 47 is thus pre- vented until the copy sheet finished count equals the frame count. Then the fuser oil supply is turned on again and a new cycle of counting and comparing image frames with copy sheets finished will be initiated.

If copier 1 is operating in the simplex mode, with the number of imaged frames equal to number of copy sheets finished, then during the course of a copy run, the supply of fuser oil to rollers 132 and 146 is maintained on. If, however, copier 1 is operating in a duplex mode with the number of copy sheets processed by roller fuser 45 equal to half the number of imaged frames, fuser oil applied to rollers 46 and 47 for one-half of the number of images formed. In either mode, the amount of fuser oil applied to rollers 46 and 47 will be maintained constant for the number of copy sheets which are passed through the nip formed by rollers 46 and 47. Thus, undesirable excessive buildup or depletion of fuser oil on rollers 46 and 47 is avoided.

Under certain conditions, recirculating feeder 25 may be operated in a skip frame mode such that only two originals are continuously recycled but the feeder cycle time is equivalent to three frames on member 2. In such case, the fuser oil control technique of the present invention will compensate for this mode of operation of the recirculating feeder in the same way that the duplex mode is compensated for. Thus, fuser oil applied to rollers 46 and 47 is not solely dependent upon the number of frames counted, but rather on a comparison of the number of frames counted with the number of copy sheets processed by roller fuser 45.

It is thus seen that apparatus for controlling the rate of application of fuser oil to the rollers of a roller fuser is provided which maintains the amount of fuser oil at a constant rate as a function of the number of copy sheets which are processed by the roller fuser. If the number of image frames is greater than the number of finished copy sheets during a copy run, the application of oil will be inhibited to prevent build up of excess fuser oil on the fuser rollers to avoid staining copy sheets. At the same time, fuser oil is maintained constant on the fuser rollers so that there is always a sufficient quantity to prevent offset of toner and other debris to the surface of the rollers.

The invention has been described in detail with particular reference to preferred embodiments thereof, but it will be understood that variations and modifications can be effected within the scope and spirit of the invention.

What is claimed is:

1. In reproduction apparatus including means for forming fixable images on one or both sides of a series of copy sheets constituting a copy run, first and second fuser rollers forming a nip through which said copy sheets are passed to fix the images to the copy sheets, and actuable means for applying, when actuated, fuser release material to at least one of said rollers, the improvement comprising:

first means for detecting fixable images formed during a copy run of said reproduction apparatus;

second means for detecting copy sheets exiting from the nip of said fuser rollers; and control means (1) for counting the number of fixable images detected by said first detecting means after the start of a copy run, (2) for counting the number of copy sheets detected by said second detecting means after the start of a copy run, and (3) for actuating said means for applying when said count of fixable images and said count of copy sheets have a preselected numerical relationship which provides an optimal application of release material per copy sheet and for deactuating said means for applying to discontinue the applying of fuser release material when said count of fixable images and said count of copy sheets do not have said preselected numerical relationship.

2. The apparatus of claim 1 wherein said means for applying applies fuser release material to both of said rollers.

3. The apparatus of claim 1 wherein said means for applying includes first and second applicators for applying fuser release material to said first and second fuser rollers respectively and wherein said control means actuates said first applicator for a fewer number of counted copy sheets than for said second applicator.

4. The apparatus of claim 1 wherein said preselected numerical relationship comprises an equality of the number of images counted with the number of copy sheets counted.

5. The apparatus of claims 1, 2, 3, or 4 wherein said means for applying fuser release material applies fuser oil to said fuser roller(s).

6. In electrographic apparatus including movable image transfer member defining a plurality of selectable image areas, means for forming toner images on said image areas of said transfer member, means for moving said transfer member along a path past said means for forming, means for supplying copy sheets seriatim along a sheet path for receiving toner images from said image transfer member on either one or both sides of said copy sheets, and a roller fuser having first and second rollers forming a nip disposed along said copy sheet path for fusing toner images carried by said copy sheets, apparatus for con- trolling the application of fuser release material to said roller fuser comprising:

first means for detecting the image areas of said image transfer member as said member moves past a detecting location;

second means for detecting copy sheets as they exit from the nip of said roller fuser;

means for applying fuser release material to said roller fuser; and control means (1) for counting the number of image areas detected by said first detecting means after the start of a copy run; (2) for counting the number of copy sheets detected by said second detecting means after the start of a copy run; and (3) for actuating said means for applying to apply fuser release material to said roller fuser when said count of image areas and said count of copy sheets bear a preselected numerical relationship with each other and for deactuating said means for applying to inhibit application of release material to said roller fuser when said count of image areas and said count of copy sheets do not bear said preselected numerical relationship with each other.

7. The apparatus of claim 6 wherein said means for applying includes first and second applicators for applying fuser release material to said first and second rollers, respectively, of said roller fuser.

8. The apparatus of claim 6 wherein said preselected numerical relationship comprises an equality of the number of image areas counted with the number of copy sheets counted.

* * * * *